United States Patent [19]

Riss

[11] Patent Number: 4,919,061

[45] Date of Patent: Apr. 24, 1990

[54] BUTTON-HOLE SEWING MACHINE HAVING A THREAD CUTTING AND CLAMPING DEVICE

[75] Inventor: Gerhard Riss, Bielefeld, Fed. Rep. of Germany

[73] Assignee: Durkoppwerke GmbH, Fed. Rep. of Germany

[21] Appl. No.: 336,822

[22] Filed: Apr. 12, 1989

[30] Foreign Application Priority Data

Apr. 12, 1988 [DE] Fed. Rep. of Germany ..... 3812092

[51] Int. Cl.[5] ..... D05B 65/02; D05B 3/06

[52] U.S. Cl. ..... 112/70; 112/253; 112/293

[58] Field of Search ..... 112/70, 76, 65, 68, 112/293, 294, 253, 285, 286

[56] References Cited

U.S. PATENT DOCUMENTS 3,847,101 11/1974 Tolle ..... 112/70 X
4,550,672 11/1985 Kastrup ..... 112/293

FOREIGN PATENT DOCUMENTS 2053559 5/1972 Fed. Rep. of Germany ..... 112/253

OTHER PUBLICATIONS

Durkopp 556, "Instructions for Seamstresses and Mechanics", Sept., 1984.
Durkop 556, "Parts list and Sewing Devices", Dec. 1982.

*Primary Examiner*—Peter Nerbun
*Attorney, Agent, or Firm*—Ostrolenk, Faber, Gerb & Soffen

[57] ABSTRACT

For producing properly shaped button holes in which the first zigzag stitches of the first button-hole caterpillar pattern are formed flat by covering the needle-side piece of thread which is held clamped, the button-hole sewing machine 1 is provided with a push device 41, a release device 58 and a shift mechanism 78. In this way, the thread cutting and clamping device 26 is moveable in synchronism with a material-presser basket 9 during its first phase of motion (I-II) which is directed parallel to the sewing-material transport direction NV. Furhtermore, towards the end of the first movement phase I-II, the needle-side piece of thread which is held clamped at the beginning of the sewing is automatically released by the release device 58 at a predetermined place so that it is completely covered by the following zigzag stitches of the first button-hole caterpillar pattern 92.

11 Claims, 12 Drawing Sheets

BUTTON-HOLE SEWING MACHINE HAVING A THREAD CUTTING AND CLAMPING DEVICE

BACKGROUND OF THE INVENTION

1. Field of the Invention

The present invention relates to a buttonhole sewing machine having a thread cutting and clamping device.

2. Background Art

A known stitch-group sewing machine, in particular a button-hole sewing machine, has a thread cutting and clamping device (Federal Republic of Germany Pat. No. 2,053,559) which at the end of a working cycle cuts the needle thread and holds the needle-side end of the thread fast so as to prevent its becoming unthreaded when the sewing recommences. The disclosures of this, and all other prior art materials cited herein, are expressly incorporated by reference.

This known button-hole sewing machine also has, between the sewing needle and the thread cutting and clamping device, a lowerable hold-down device which, in the immediate vicinity of the sewing needle, presses with slight force against the part being sewn. In this way, particularly in the case of large-mesh knitted articles, the high-pile material being sewn is held down in the immediate region of the place of sewing, so that a suitable sewing result is obtained.

In addition to cutting the needle thread, the thread cutting and clamping device also brings the end of the needle thread into a position in front of the sewing needle and holds it fast, in such a way that it is sewn over or covered by the zigzag seam produced.

During the sewing of the first stitches for the first button-hole caterpillar pattern, the thread cutting and clamping device in the known button-hole sewing machine does not carry out any movement at the place intended for the commencement of the sewing. At this time, the material-presser basket, in known cooperation with a lengthwise pusher, transports the sewing part clamped between the two of them in the direction toward the sewing needle. This produces a thread-tensioning force, which increases with the number of zigzag stitches, in the end of the needle thread which is held clamped. In this way, the hold-down device is raised, the end of the needle thread which is held fast extending obliquely upwards, starting from the place of sewing, towards the thread cutting and clamping device. As a result of this, the zigzag stitches of the first button-hole caterpillar pattern which are now formed are pulled up when the end of the needle thread which is held fast is oversewn, and this with an increasing amount of force. At a given point, the thread tensile force has reached such a value that the end of the needle thread which had previously been held clamped is pulled out of the thread clamping device. Since now the thread tensioning force in the free end of the needle thread has dropped to the value of zero, a normal button-hole caterpillar pattern with flat-formed zigzag stitches is produced from this time on.

This known button-hole sewing machine, therefore, has the disadvantage that in the initial region of the first button-hole caterpillar pattern, some of the zigzag stitches are pulled upward, but are then, however, pulled properly later in the sewing procedure. This defect is objected to by those skilled in the art who wish to produce quality button holes.

SUMMARY OF THE INVENTION

The main object of the present invention, therefore, is to improve this type of button-hole sewing machine in such a manner that it permits the production of properly formed button holes.

This object is achieved in a button-hole sewing machine for sewing a button hole consisting essentially of two generally parallel button-hole caterpillar patterns, comprising;

an arm; an arm stand; and a base;

means for transporting a sewing-material workpiece in a workpiece transport direction, across the base and toward the sewing needle;

a needle bar which reciprocates in a direction transverse to the workpiece transport direction and carries a sewing needle;

a material-presser basket; a presser block supported on said arm and operable to urge the basket toward said workpiece;

a thread cutting and clamping device; and controlling means for controlling said thread cutting and clamping device, said controlling means being operable to cause the thread cutting and clamping device to catch the needle thread at the end of sewing an initial button hole, to cut said thread, and to hold it until releasing it during the sewing of a further button hole.

According to highly advantageous features of such a machine, said controlling means comprises push means, release means, and shift means which cooperate for controlling said thread cutting and clamping device.

The button-hole sewing machine of the invention has a thread cutting and clamping device which is moveable in the direction toward the sewing needle synchronously with the material-presser basket within the initially sewed region of the first button-hole caterpillar pattern. In this way, no thread tension force is built up in the end of the needle thread which is held clamped.

Furthermore, the invention has the further advantage that the thread cutting and clamping device opens automatically at a pre-determined position and thus releases the end of the needle thread which up to then has been held clamped.

Other objects, features and advantages of the invention will be appreciated from the following detailed description of an embodiment of the invention, with reference to the drawings.

DETAILED DESCRIPTION

Figure 1:
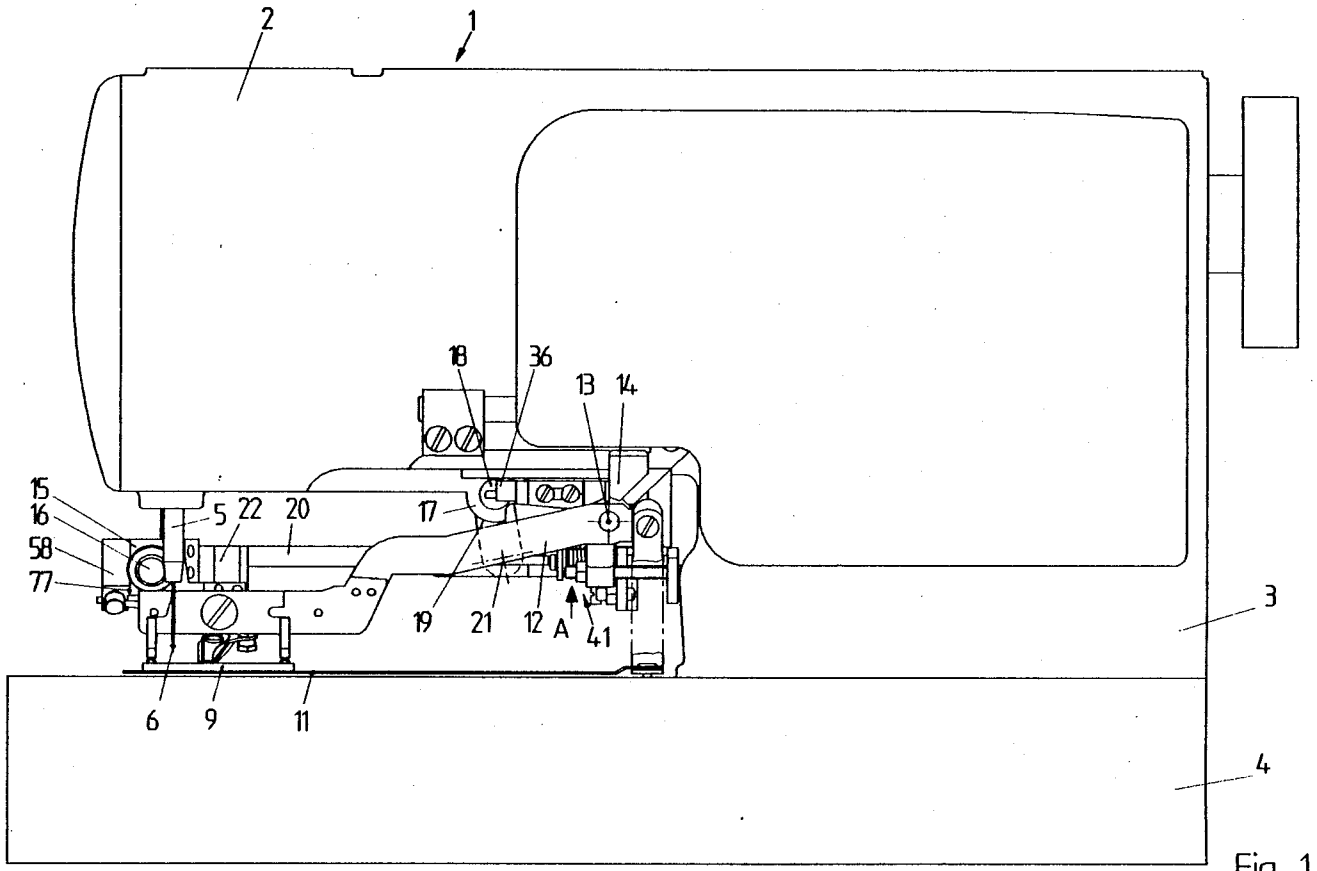
FIG. 1 is a simplified view of the button-hole sewing machine from one side.
Figure 2:
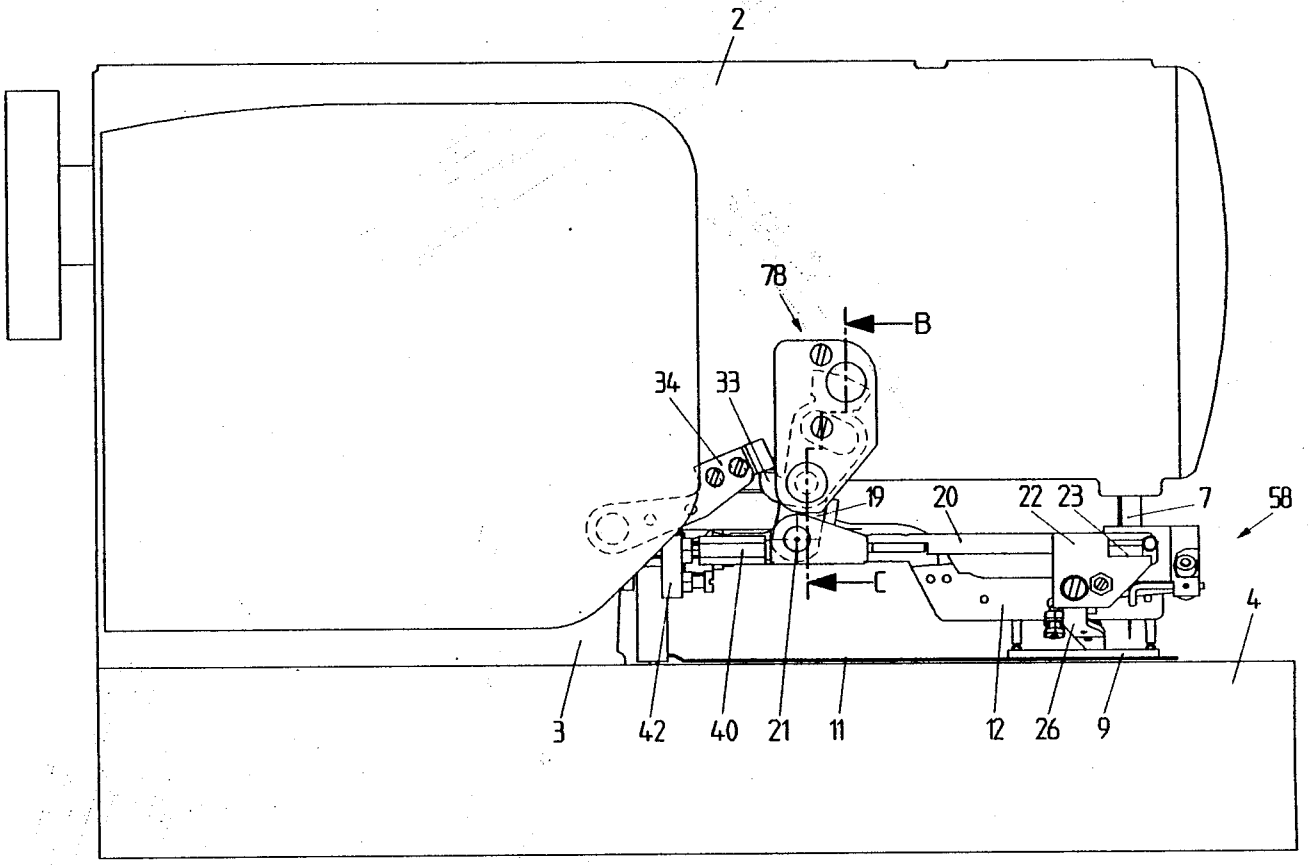
FIG. 2 is a simplified view of the button-hole sewing machine from the other side.
Figure 3:
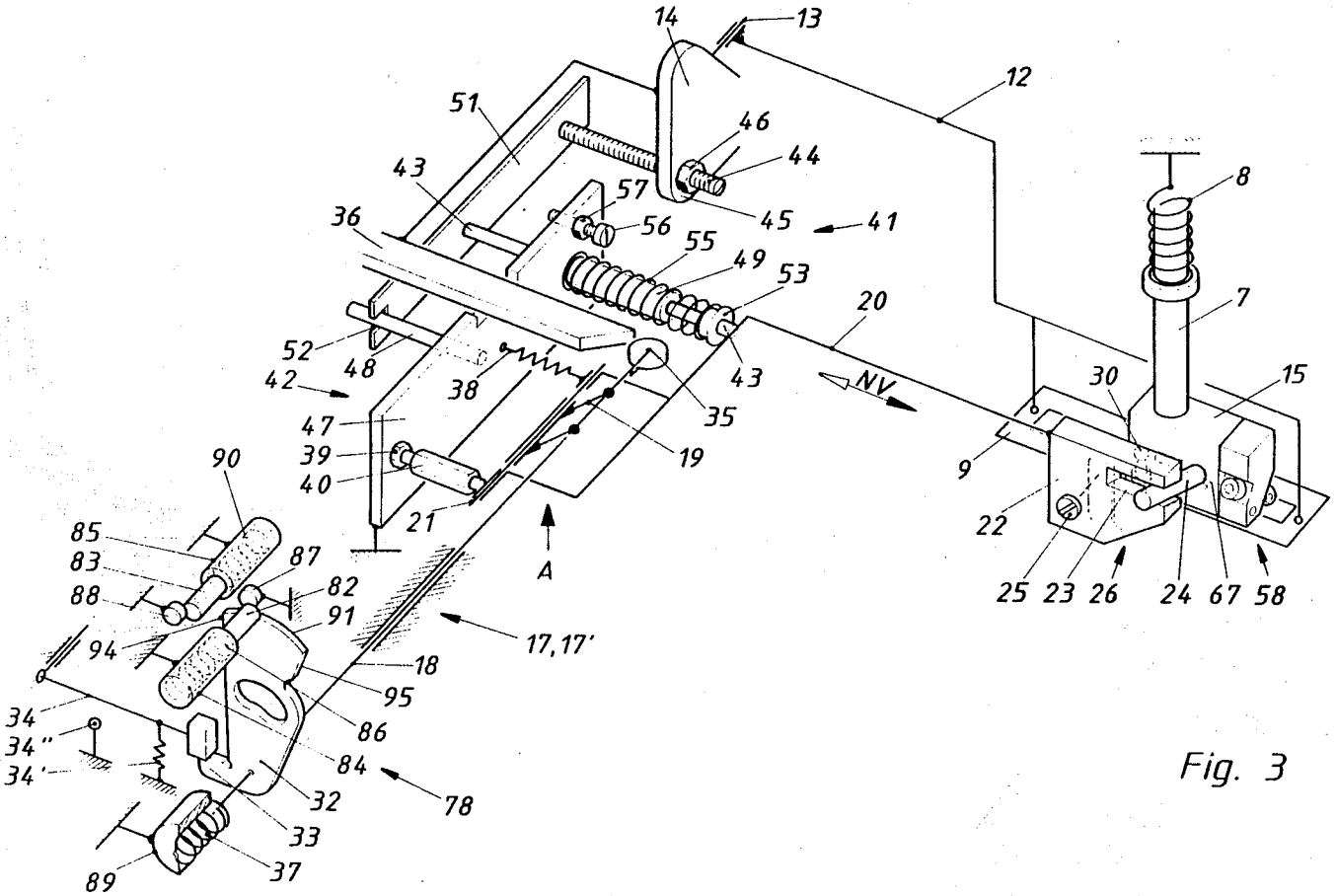
FIG. 3 is a simplified schematic diagram of the drive of the thread cutting and clamping device.
Figure 4:
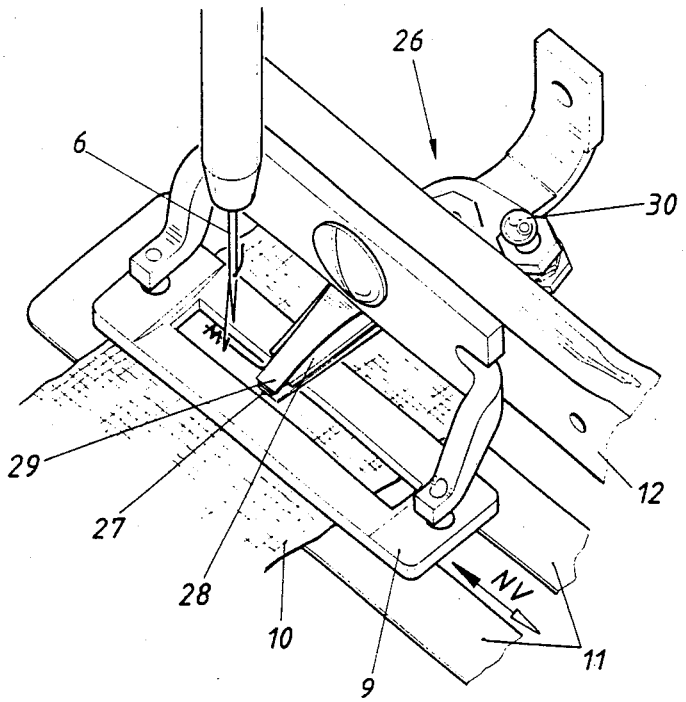
FIG. 4 is a perspective view of the material-presser basket and the surrounding components.
Figure 5:
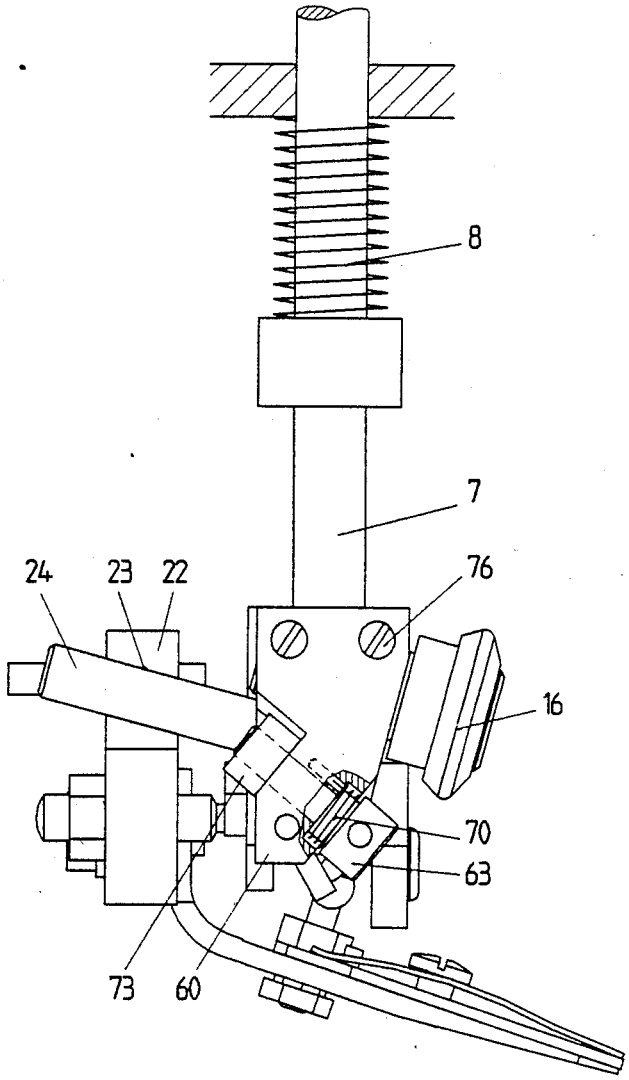
FIG. 5 is a side view of the thread cutting and clamping device and of the release device.

FIG. 1 shows a button-hole sewing machine 1 which, as is known per se, consists essentially of an arm 2, an arm stand 3 and a base plate 4. At the front region of the arm 2 is a needle bar 5 which oscillates vertically and transverse to the sewing-material transport direction NV and receives a sewing needle 6, and a material-presser rod 7 (FIG. 2) which can be lifted upward against the action of a compression spring 8 (FIGS. 3 and 5). A frame-like material-presser basket 9, known per se, surrounds the sewing needle 6, as shown in FIG. 4, and makes it possible for a workpiece to be sewn 10 to be held reliably in the region where the sewing is to be carried out. The basket 9 cooperates with a lengthwise pusher 11 to transport the workpiece 10 in the sewing-material transport direction NV either towards the sewing needle 6 or away from it.

The material-presser basket 9 is fastened to a basket guide lever 12 which is pivotally connected, at a pivot point 13, to a lengthwise pusher pedestal 14. The pusher pedestal 14 is mounted in the arm stand 3 and driven in known manner by a cam drive, described further hereinbelow, for displacement in known manner parallel to the base plate 4. A presser block 15, which is connected firmly to the material-presser rod 7, bears upon the basket guide lever 12 in known manner, via a roller 16 supported on the rod 7 (FIG. 5), in such a way that both the material-presser basket 9 and the lengthwise pusher 11—controlled by the action of the compression spring 8—are pressed against the surface of the base plate 4.

Two bearing lugs 17, 17' are provided on the arm 2. A push shaft 18 with which a rocker 19 is firmly connected is mounted on the bearing lugs 17, 17'. A carrier 20 is pivotally connected to the rocker 19 at an articulation point 21 and provided on its free end with a guide part 22 having a fork 23. A guide pin 24 which is directed obliquely upward, as shown in FIGS. 3 and 5, is press-fitted in the presser block 15 and is received by the fork 23. The upper flank of the fork 23, as shown in FIG. 3, is aligned in this connection with the guide pin 24.

Figure 6:
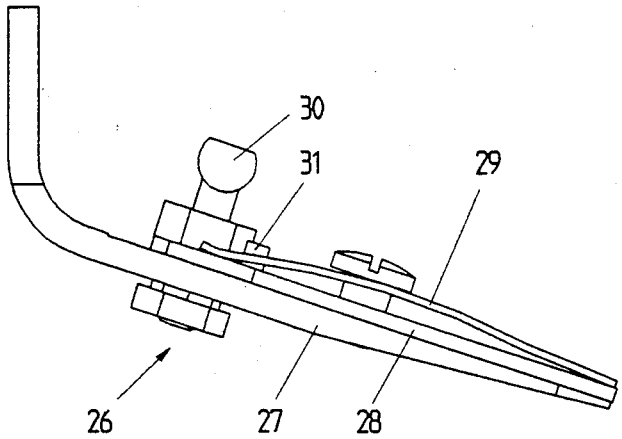
FIG. 6 is a detailed side view of the thread cutting and clamping device.

As shown in FIGS. 3, 6, 8 and 9, a thread cutting and clamping device 26 is fastened by a screw 25 to the guide part 22. As shown in FIG. 6, the device 26 comprises a stationary lower knife 27, a swingable upper knife 28, a thread-clamping plate 29 which rests on the latter and a ball pin 30 which is mounted on the upper knife 28 via an eccentrically arranged pin, whereby the ball pin 30 is adjustable relative to the upper knife 28. The thread-clamping plate 29, despite the movement from time to time of the swingable upper knife 28, remains in stopped position due to a stop pin 31 which is press-fitted in the stationary lower knife 27.

A stop lever 32 (FIG. 3), which will be described further below, is firmly attached by soldering to the push shaft 18. A holding nose 33 provided on the stop lever 32 cooperates with a locking pawl 34 (FIG. 2). The latter is pivotally mounted on the arm stand 3 and is pulled by a spring 34' against a resting surface, for instance a stop 34".

On one end of the push shaft 18 there is provided, in known manner, a turnable roller 35 with barreled circumference. The oblique engagement surface of a cam 36 which is rigidly connected to the lengthwise pusher pedestal 14 can move temporarily against said roller. In this way, the push shaft 18 is displaced a defined distance against the action of a compression spring 37, in known manner.

Figure 7:
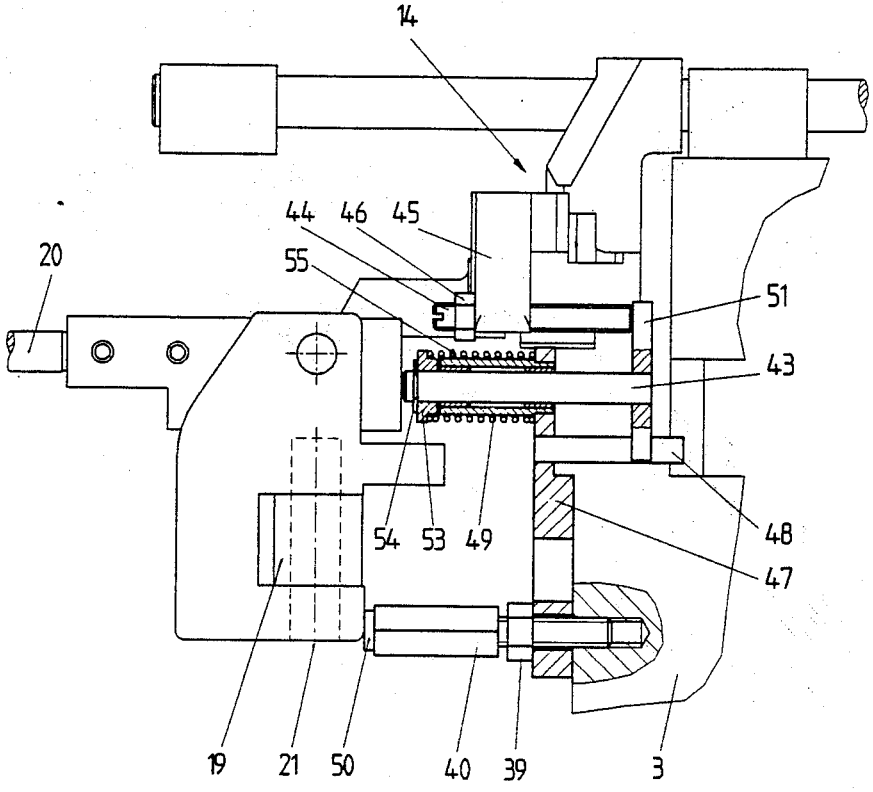
FIG. 7 is a bottom view of the push device, seen in the direction of the arrow "A" in FIG. 1.

Referring now to FIGS. 3 and 7, a tension spring 38 is provided, between one spring lug which is connected to the carrier 20, and another spring lug fixed to the frame. The end position of the carrier 20 is limited by an adjustable stop 40 which is secured in position by a lock nut 39 and is supported firmly on the frame and provided in known manner with a rubber bumper 50. The stop 40 is adjustable by screwing it in or out of the threaded hole in the arm stand 3 which receives it, which hole is deeper than would otherwise be necessary (see FIG. 7).

The course of movement of the above-described structural parts as well as the production of these courses of movement are disclosed in the following publications:

1. "DURKOPP 556, Instructions for Seamstresses and Mechanics," edition of 9/1984, 2. "Parts List and Sewing Devices, DURKOPP 56," edition of 12/1982.

Therefore, a further description of these courses of movement as well as the parts which produce them can be dispensed with.

The assemblies in accordance with the invention and the structural parts which cooperate directly with them are described below.

A push device 41, best seen in FIG. 3, comprises a carrier member 42, a push bolt 43 and a stop pin 44. The latter is screwed into a bearing lug 45 which is mounted on the lengthwise pusher pedestal 14. After proper operational adjustment of the stop pin 44, it is held in secured position by a lock nut 46. The carrier member 42 comprises a strap 47 to which a unilaterally protruding pin 48 is firmly attached, as shown in FIGS. 3 and 7. Furthermore, mounted in the strap 47 is a bearing bush 49 in both ends of which, commercial plastic-coated slide rings are pressed-in. The carrier member 42 is attached firmly by means of two attachment screws—one of which is the above-mentioned stop 40—to the arm stand 3, as shown in FIGS. 2 and 7.

The push bolt 43 is displaceably supported in the bearing bush 49 and a plate 51 is firmly connected to its one end. This plate has a slot 52 which surrounds the pin 48, as a result of which the plate 51 and the push bolt 43 are displaceable but secured against turning.

At the other end of the push bolt 43, a ring 53 is provided which is secured against being lost by a commercial retainer 54 A compression spring 55 is pushed over the outer circumference of the bearing bush 49 and is arranged between the ring 53 and the strap 47, as shown in FIG. 7. A stop screw 56, is also screwed into the strap 47, the adjusted position of the stop screw 56 being secured by a lock nut 57.

Figure 9:
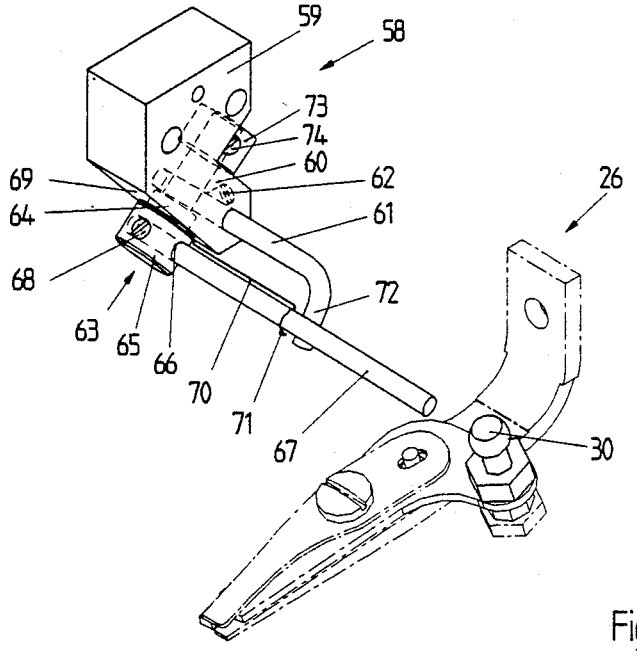
FIG. 9 is a perspective view of the release device.

A release device 58, best seen in FIG. 9, comprises a bearing plate 59 which an obliquely directed extension 60 in which a hook 61 is fastened in known manner by means of a threaded pin 62. A stop lever 63 is swingably mounted in the extension 60. The stop lever comprises an attachment bolt 64, the head part 65 of which has a transverse bore 66 extending through the axis of symmetry of the attachment bolt 64. The stop lever also has a stop pin 67 which is firmly attached to the head part 65 by a threaded pin 68.

Between a surface 69 of the extension 60 and the opposing annular surface on the head part 65, a torsion spring 70 is provided, one leg thereof being connected in form-locked non-moveable manner to the extension 60 while another leg 71 thereof grips around the stop pin 67. In this way, the stop pin 67 rests, in the position of rest of the stop lever 63, against a leg 72, of the hook 61.

Figure 8:
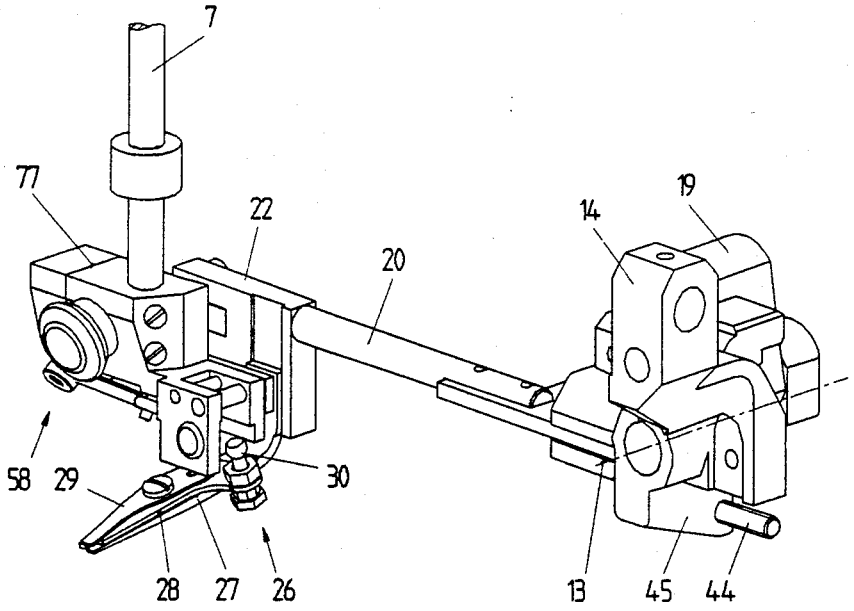
FIG. 8 is a perspective view of the thread cutting and clamping device, the material-presser basket not being shown.

A setting ring 73 is fastened by means of a threaded pin 74 on the free end of the attachment bolt 64 in order to permit unimpeded mobility of the stop lever 63 mounted in the extension 60. The release device 58 is fastened by two screws 76 to a face side 77 of the presser block 15 (FIGS. 3, 5 and 8).

Figure 10:
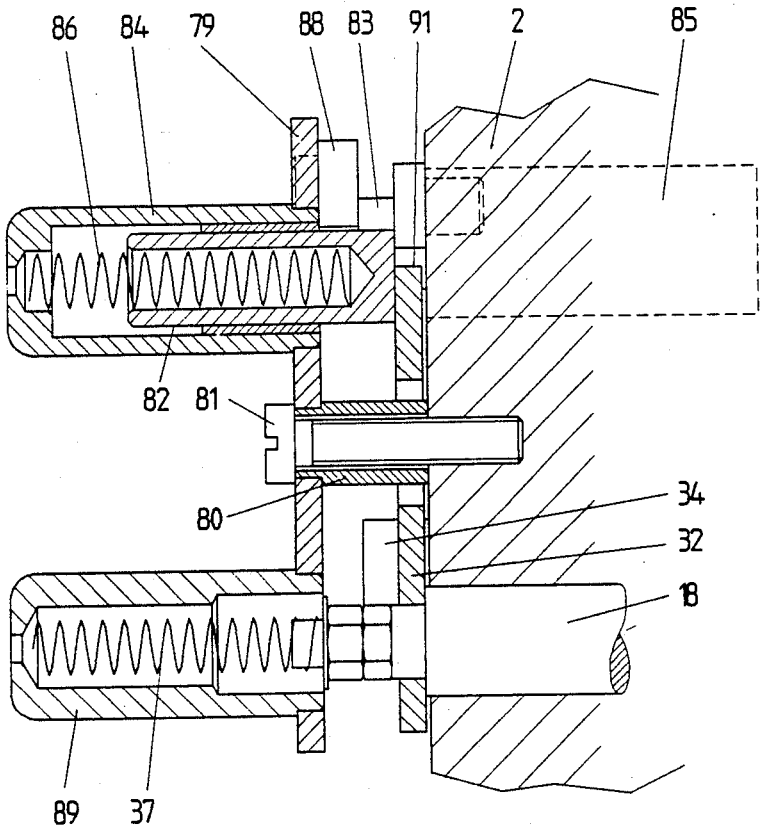
FIG. 10 is a cross-sectional view taken along the line B-C in FIG. 2 through the shift mechanism which holds the thread cutting and clamping device in the "start of sewing" position.

As shown in FIG. 2, a shift mechanism 78 is provided at the rear of the arm 2. Referring to FIG. 10, for example, it includes: a plate bar 79 which is fastened by means of two spacer sleeves 80 and two screws 81 to the arm 2; two (first and second) stop bolts 82 and 83; and the stop lever 32, which is fastened to the push shaft 18. The first stop bolt 82 is displaceably mounted via an ordinary slide bushing in a sleeve 84, which is firmly attached to the plate bar 79. A compression spring 86 causes the first stop bolt 82 to rest in unloaded condition against a pin 87 (FIG. 12) force-fitted in the arm 2, the front surfaces of the first stop bolt 82 and the pin 87 overlapping slightly, as shown in FIGS. 3 and 10. Another sleeve 89, into which the push shaft 18 from time to time enters against the action of the compression spring 37, as shown in FIG. 13, is rigidly connected to the plate bar 79.

Figure 11:
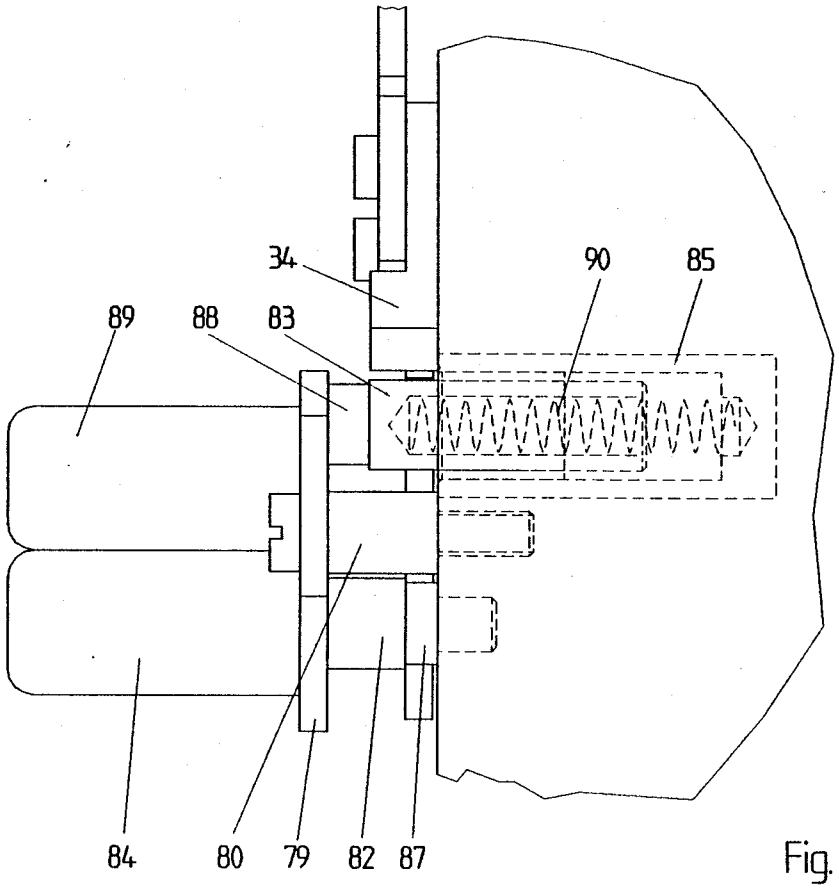
FIG. 11 is a top view of the shift mechanism, in the position shown in FIG. 10.

The second stop bolt 83 is mounted via an ordinary slide bushing, in displaceable fashion in another sleeve 85 which is force-fitted in the arm 2, as shown in FIG. 11. Another compression spring 90, provided in the sleeve 85, has the result that the stop bolt 83 rests in unloaded condition against a pin 88 which is force-fitted in the plate bar 79, the front surfaces of the stop bolt 83 and of the pin 88 overlapping slightly, as shown in FIG. 3. The pins 87, 88 assume such a position that a circumferential surface 91 on the stop lever 32 does not contact the pins 87, 88 during its swinging (see FIGS. 3, 10, 13).

The manner of operation of the button-hole sewing machine of the invention will now be described.

Figure 15:
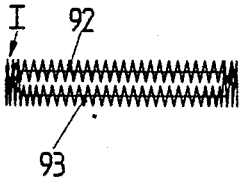
FIG. 15 is a finished button hole, with the start of sewing marked.

In FIG. 3 the thread cutting and clamping device 26 is in a position which corresponds to the start of sewing (I) of a button hole shown in finished condition in FIG. 15. Such a button hole comprises a first button-hole caterpillar pattern 92 and a second button-hole caterpillar pattern 93.

Figure 16:
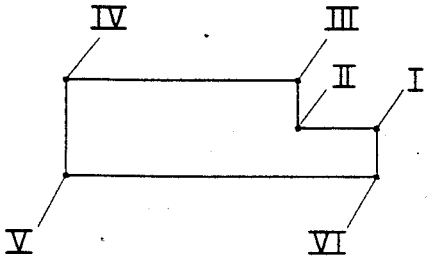
FIG. 16 is a diagram of the course of movement of the thread cutting and clamping device.
Figure 14:
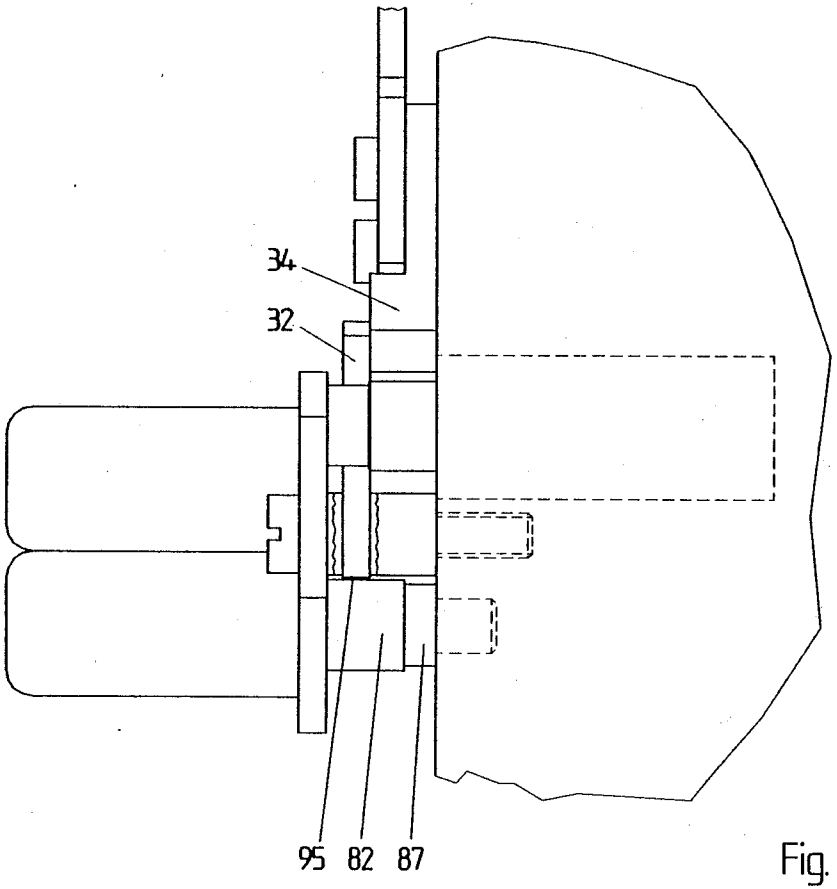
FIG. 14 is a top view of the shift mechanism, in the position shown in FIG. 13.

At the time of the start of sewing (I), the needle-side end of the thread is held between the upper knife 28 and the thread-clamping plate 29 during the first zigzag stitches (see FIG. 4). At the start of the operating cycle, the material-presser basket 9 moves in the direction towards the sewing needle 6, this movement being produced by the lengthwise pusher pedestal 14 which moves in the same direction. Since the stop pin 44 also moves in this direction, the plate 51 and the push bolt 43 follow the aforementioned movement of the lengthwise pusher pedestal 14 under the influence of the now-relaxing compression spring 55. Since the tip of the push bolt 43, as shown in FIGS. 3 and 7, rests against the corresponding edge of the carrier 20, the latter, including the thread cutting and clamping device 26 firmly attached to it, is moved in the direction towards the sewing needle 6. This movement of the carrier 20 takes place against the action of the tension spring 38. By this movement, the corresponding edge of the carrier 20 lifts off from the stop 40; and the push shaft 18 is rotated, as shown in FIG. 3, via the articulation point 21 and the rocker 19, so far in the counterclockwise direction that a first surface 94 of the stop lever 32 comes against the extracted second stop bolt 83. In this way, the position (II) shown in FIG. 16 is reached, which position—as previously described—is secured by the surface 94 resting against the second stop bolt 83 and under the action of the spring force of the compression spring 55. That is, the carrier 20 momentarily cannot carry out any further movement parallel to the direction of transport NV of the material being sewn.

During the phase I-II which can be noted from FIG. 16, the thread cutting and clamping device 26 moves synchronously with the material-presser basket 9, as a result of which the end of the thread which is held clamped on the needle side is held free of tension in accordance with FIG. 4 and is thus covered by the first zigzag stitches of the first button-hole caterpillar pattern 92 in such a manner that a flat-lying button-hole caterpillar pattern 92 is produced.

Shortly before reaching position II, the ball pin 30, as shown in FIGS. 3, 8 and 9, comes against the stop pin 67, as a result of which the upper knife 28 swings slightly in the clockwise direction. As a result, the end of the needle thread which was previously clamped between the upper knife 28 and the thread-clamping plate 29 is released and is then covered completely by the following zigzag stitches of the button-hole caterpillar pattern 92 which is being formed.

Upon reaching the position II, the oblique surface of the cam 36, which is rigidly connected with the lengthwise pusher pedestal 14, comes against the roller 35 and thus displaces the push shaft 18 and the stop lever 32 against the action of the compression spring 37. During this pushing movement, the surface 94 slides along the second stop bolt 83, the stop lever 32 pressing the first stop bolt 82, against the action of the compression spring 86, into the sleeve 84 (see FIG. 12).

Figure 12:
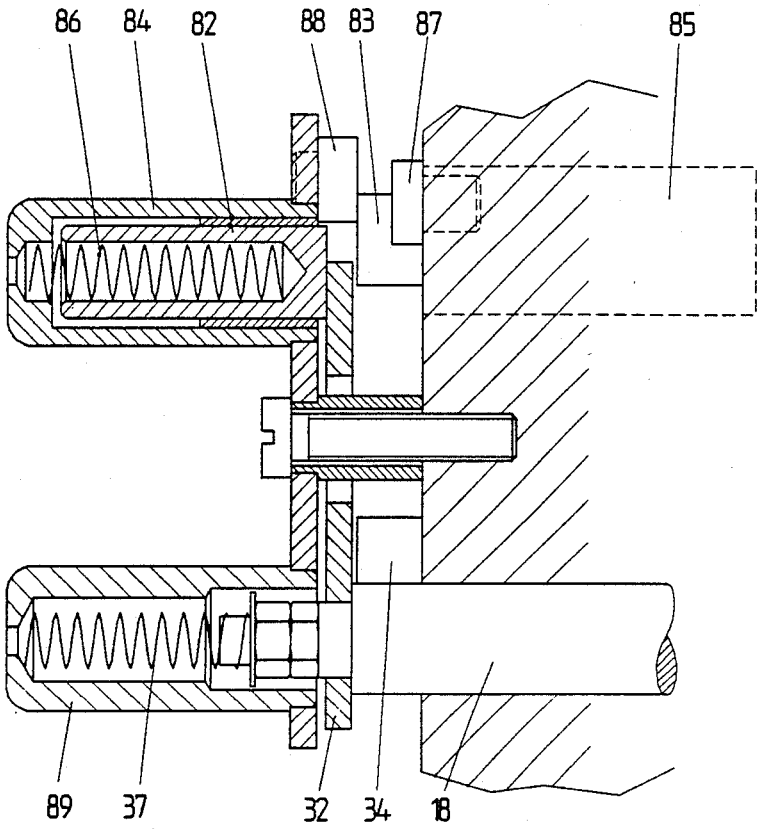
FIG. 12 is a cross-sectional view taken along the line B-C in FIG. 2 through the shift mechanism, the push shaft 18 and the stop lever 32 connected to it being shown in their leftward position.
Figure 13:
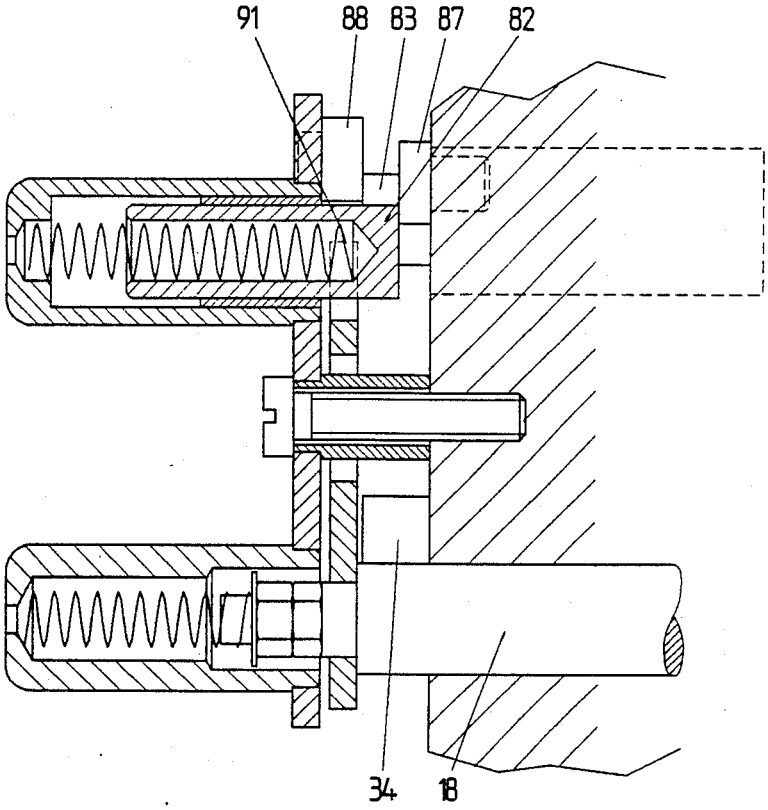
FIG. 13 is a cross-sectional view taken along the line B-C in FIG. 2 through the shift mechanism which is positioned for holding the thread cutting and clamping device in the "waiting" position.

In this further extracted position of the stop lever 32, shown in FIG. 12, its holding nose 33 is slid over by a block provided on the free end of the locking pawl 34 (FIG. 2). As a result, the locking pawl 34 swings in clockwise direction under the influence of the relaxing spring 34' until the locking pawl 34 rests against the stop 34''. The block of the locking pawl 34 which is now alongside the stop lever 32, as shown in FIGS. 12 and 13, prevents the momentary displacement of the stop lever 32. During the above-described pushing movement of the push shaft 18, the upper knife 28 is swung in clockwise direction, so that now a maximum angle of opening is present between it and the lower knife 27.

Since in the previously described extracted position—which corresponds to position III in FIG. 16—of the stop lever 32, the surface 94 of which has been slid over by the stop bolt 83, the previously arrested position of the carrier 20 is thus released. In this way, the compression spring 55 can relax additionally in a second phase III–IV, as a result of which the push bolt 43 suddenly brings the carrier 20 into a position which is limited in the manner that the plate 51 comes against the tip of the stop screw 56. Since simultaneously with the sudden movement of the carrier 20 just described, the stop lever 32—since it is no longer arrested by the stop bolt 83—is swung in counterclockwise direction so that the inwardly pressed stop pin 82 is released, it immediately moved outward until it rests against the pin 87 (see FIG. 13). By the relaxing tension spring 38, a second surface 95 of the stop lever 32 now comes against the extracted stop bolt 82, as a result of which the position IV, shown in FIG. 16, is reached. The thread cutting and clamping device 26 remains in this arrested position, also referred to as waiting position IV', until the button hole has been completely sewn. The aforementioned waiting position IV' is characterized by the fact that the upper knife 28 and the lower knife 27 are in open position and therefore namely in position ready to cut.

Independently of the thread cutting and clamping device 26 which remains in the waiting position IV', the material-presser basket 9 moves in the above-described direction (shown as a solid arrow in FIG. 3) until the button-hole caterpillar pattern 92 is completely sewn. A change in direction of the material-presser basket 9 then takes place, it now moving in the direction indicated by the open arrow (see FIG. 3), in which connection, the lock stitches are produced at the end of the first button-hole caterpillar pattern 92 and thereupon the second button-hole caterpillar pattern 93 is sewn. In this connection, the stop pin 44, which now moves also in the direction of the open arrow, comes against the plate 51 and brings the latter again into its end position, shown in FIGS. 3 and 7, in which the compression spring 55 is again cocked. The pushing device 41 has thus assumed its inactive initial position.

After completion of the button hole, the lifting of the material-presser basket 9 is automatically commenced. At the beginning of this lifting process—before the material-presser basket 9 lifts off—the locking pawl 34 is positively swung upward. After it has released the stop lever 32, the latter moves under the influence of the relaxing compression spring 37 into the position shown in FIG. 10, its surface 95 sliding along the stop bolt 82. In this way, the thread cutting and clamping device 26 is brought linearly out of the waiting position IV' into the cutting position V. In this connection, the needle thread is cut off above the button hole and the needle-side piece of thread is held clamped between the upper knife 28 and the thread-clamping plate 29. At this time, the surface 95 has slid off from the stop bolt 82, as a result of which the carrier 20 is brought into its initial position, shown in FIG. 3, under the influence of the tension spring 38 which now relaxes, resting in this position against the stop 40. At the same time, the stop lever 32 is swung in clockwise direction into the position shown in FIG. 3, the locking pawl 34 having placed itself again on the holding nose 33. By the movement of the carrier 20, the thread cutting and clamping device 26 has been brought into the position VI. In the further course of the aforementioned lifting of the material-presser basket 9, the thread cutting and clamping device 26 is transferred from the position VI to the position I which corresponds to the next following start of sewing, as a result of which all preparations for a subsequent operating cycle have been concluded.

Although the invention has been described herein with respect to a specific embodiment thereof, the claimed invention is not limited to such embodiment, but rather is to be construed as including all modifications and variations that may occur to one having ordinary skill in the art, which fairly fall within the teaching set forth herein.

What is claimed is:

1. A button-hole sewing machine for sewing a button hole consisting essentially of generally parallel first and second button-hole caterpillar patterns, comprising:

an arm; an arm stand; and a base;

means for transporting a sewing-material workpiece in a workpiece transport direction, across the base and toward the sewing needle;

a needle bar which reciprocates in a direction transverse to the workpiece transport direction and carries a sewing needle;

a material-presser basket; a presser block supported on said arm and operable to urge the basket toward said workpiece;

a thread cutting and clamping device; and controlling means for controlling said thread cutting and clamping device, said controlling means being operable to cause the thread cutting and clamping device to move either parallel or transverse to said workpiece conveyance direction; and to catch the needle thread at the end of sewing an initial button hole, to cut said thread, and to hold it until releasing it during the sewing of a further button hole.

2. A machine as in claim 1, wherein said controlling means comprises push means, release means, and shift means which cooperate for controlling said thread cutting and clamping device.

3. A machine as in claim 2, wherein said push means comprises a push device which is operable during the sewing of said first button-hole caterpillar pattern, starting from an initial inactive starting position, to move and thereby impart movement to said thread cutting and clamping device in the workpiece transport direction and toward said sewing needle, and that during the sewing of said second caterpillar pattern, the push device is operable to return to said inactive starting position.

4. A machine as in claim 3, wherein said movement of said push device during the sewing of said first caterpillar pattern is divided into a first phase and a second phase, both being in said workpiece transport direction and toward said sewing needle.

5. A machine as in claim 4, wherein said controlling means is operable to move said thread cutting and clamping device synchronously with the material-presser basket during said first phase, and for returning the material-presser basket to a waiting position at the end of said second phase.

6. A machine as in claim 5, wherein said thread cutting and clamping device is closable to catch said thread and operable to release said thread; said release means comprising a release device which is operable to cause the thread cutting and clamping device to open at a predetermined point in its travel near the end of the first phase.

7. A machine as in claim 6, wherein said shift means comprises a shift mechanism which is operable for controlling the sequence of all movements of the thread cutting and clamping device.

8. A machine as in claim 4, wherein said push device is operable for causing said thread cutting and clamping device to move in said material transport direction toward said needle;

wherein a pusher pedestal is mounted on said arm stand and is operable to move in said material transport direction toward said needle; and wherein said push device comprises:

a carrier member including a strap secured to the arm stand of the machine; the strap being generally transverse to the workpiece transport direction;

a push bolt extending in said workpiece transport direction and through said strap; a bearing bush on said strap extending toward said needle and surrounding said push bolt;

a plate generally transverse to said transport direction and secured to said push bolt, at a position spaced from said strap and in a direction away from said needle;

an adjustable stop pin secured to said pusher pedestal, disposed for spacing said plate from said pusher pedestal;

a pin secured to said strap and extending away from said needle in said transport direction; and passing through a slot formed in the plate;

a ring secured to a position on said push bolt generally toward said needle; a compression spring between the ring and the strap and surrounding said bearing bush;

an adjustable stop screw on said strap disposed for spacing said plate from said strap; and an adjustable stop on said strap and extending toward said needle, disposed for limiting movement of said strap toward said needle.

9. A machine as in claim 6, wherein said release device comprises:

a bearing plate on said presser block;

an extension on said bearing plate directed so as to form a plane which is parallel to said transport direction and forms an angle with the plane of the workpiece;

a stop lever mounted on said extension so as to be pivotable in a plane parallel to said extension;

a hook extending from the extension generally opposite to said transport direction and having a bent leg of the hook formed at an end thereof away from the extension; and a torsion spring on the extension and urging the stop lever against the leg of the hook.

10. A machine as in claim 2, wherein the shift means comprises a shift mechanism which includes a stop lever which is rigidly connected to a push shaft, a plate bar which is fastened at a predetermined distance away on the outer side of the arm of the button-hole sewing machine, a stop bolt which is received against the action of a compression spring by a sleeve which is press-fitted in the arm, a second stop bolt which is received against the action of a compression spring by a sleeve which is press-fitted in the plate bar, and a locking pawl which is swingably supported on the arm stand, the pawl placing itself, depending on the position of the stop lever, on or alongside of a holding nose provided on said stop lever.

11. A machine as in claim 10, wherein the axes of symmetry of the first and second stop bolts are aligned parallel to the axis of symmetry of the push shaft; a first pin is press-fitted in the arm in a position which permits a slight overlap of the front surfaces of the pin and the first stop bolt; and a second pin is press-fitted in the plate bar in such a position as to make possible a slight overlap of the front surfaces of the pin and the second stop bolt.

* * * * *